US008899245B2

(12) United States Patent
Zardini

(10) Patent No.: US 8,899,245 B2
(45) Date of Patent: Dec. 2, 2014

(54) MACHINE AND METHOD FOR TREATING CONTAINERS OF LIQUIDS, AND MANIPULATOR DEVICE FOR SAID CONTAINERS

(75) Inventor: Fabio Zardini, Castelfranco Veneto (IT)

(73) Assignee: Steelco SpA, Riese Pio X (IT)

( * ) Notice: Subject to any disclaimer, the term of this patent is extended or adjusted under 35 U.S.C. 154(b) by 456 days.

(21) Appl. No.: 13/375,856

(22) PCT Filed: May 31, 2010

(86) PCT No.: PCT/IB2010/001306

§ 371 (c)(1),
(2), (4) Date: Dec. 28, 2011

(87) PCT Pub. No.: WO2010/140042

PCT Pub. Date: Dec. 9, 2010

(65) Prior Publication Data

US 2012/0111371 A1 May 10, 2012

(30) Foreign Application Priority Data

Jun. 3, 2009 (IT) ..... UD2009A0111

(51) Int. Cl.

| | |
|---|---|
| ***B08B 3/00*** | (2006.01) |
| ***B08B 9/42*** | (2006.01) |
| ***B08B 9/20*** | (2006.01) |
| ***B65B 55/24*** | (2006.01) |

(52) U.S. Cl.

CPC ..... *B08B 9/423* (2013.01); *B08B 9/205* (2013.01); *B65B 55/24* (2013.01)

USPC ..... 134/62; 134/66; 134/61; 134/76; 134/140; 414/676; 414/222.01; 414/222.02; 414/751.1; 414/429; 269/20; 269/309; 269/56; 422/1; 422/28; 422/297; 422/300; 422/303

(58) Field of Classification Search

CPC ..... B08B 9/426; B08B 9/0821; B65G 2201/0244; B65B 21/14; B25J 11/00

USPC ..... 134/18, 22.1, 23, 24, 25.1, 32, 34, 43, 134/56 R, 60, 61, 62, 66, 67, 70, 82, 133, 134/135, 137, 166 R, 172, 198, 134; 422/1, 422/28, 292, 297, 300, 303, 509, 547, 63; 414/676, 222.01, 222.02, 416.01; 269/20, 309, 56

See application file for complete search history.

(56) References Cited

U.S. PATENT DOCUMENTS

| | | | | |
|---|---|---|---|---|
| 4,911,602 | A * | 3/1990 | Abe | 414/421 |
| 2009/0101178 | A1 * | 4/2009 | Wu et al. | 134/22.18 |

FOREIGN PATENT DOCUMENTS

| | | | | |
|---|---|---|---|---|
| FR | 1039114 | A | 10/1953 | |
| FR | 2354283 | A1 | 1/1978 | |
| FR | 2 354 283 | * | 11/1981 | B67C 1/18 |

OTHER PUBLICATIONS

Abe, "Bottle feeder for washing machine has motor-driven table with bottle path controlled by pneumatic ram operated bars" FR 2 354 283 Machine Translation.*

Int'l Search Report issued Jan. 14, 2011 in Int'l Application No. PCT/IB2010/001306; Written Opinion.

* cited by examiner

*Primary Examiner* — Michael Barr
*Assistant Examiner* — Thomas Bucci
(74) *Attorney, Agent, or Firm* — Panitch Schwarze Belisario & Nadel LLP

(57) ABSTRACT

Machine (10) and method for treating containers (12) of liquids comprising in succession at least a loading station (15), into which the containers (12) to be treated are loaded, and all disposed according to a determinate first orientation, and a washing station (17), in which the containers (12) are subjected at least to washing and are disposed in a second orientation able to promote the fall due to gravity of the dirt and/or washing liquid present in the containers (12). The machine (10) comprises, downstream of the washing station (17) and outside it, a manipulator device (41) which automatically rotates the containers (12) exiting form the washing station (17) so as to reposition the containers (12) according to the first determinate orientation.

3 Claims, 3 Drawing Sheets

MACHINE AND METHOD FOR TREATING CONTAINERS OF LIQUIDS, AND MANIPULATOR DEVICE FOR SAID CONTAINERS

CROSS-REFERENCE TO RELATED APPLICATION

This application is a Section 371 of International Application No. PCT/IB2010/001306, filed May 31, 2010, which was published in the English language on Dec. 9, 2010, under International Publication No. WO 2010/140042 A2, and the disclosure of which is incorporated herein by reference.

FIELD OF THE INVENTION

The present invention concerns a machine and a method for treating in an automated manner containers of liquids, for example, but not exclusively, bottles, feeding bottles, watering troughs or other containers or recipients to feed animals. In particular, with the present invention it is possible to wash, rinse, fill and re-close the containers in a substantially automated manner, and with the minimum manual intervention of an operator.

BACKGROUND OF THE INVENTION

Machines are known which are used for washing containers of liquids, such as but not only, bottles, feeding bottles, watering troughs or others, used for feeding animals, such as for example guinea pigs or laboratory rodents or others.

It is known that, before washing, the containers are closed by suitable lids, or capsules; the lids are shaped with a lip to allow the animal to consume the liquid contained in the container, and the containers must be provided at the end of washing closed and filled with new liquid.

It is known to provide machines for washing the containers, which are structured with a support frame provided with a base resting on the ground and with a plurality of operating stations disposed in line with respect to each other, including a loading station for the closed containers, a station for removing the capsules from the containers, or de-lidding station, a washing station, a filling station and one to re-close the containers which have been washed and filled, by means of said capsules.

In the known machines, except for the washing station, in which the containers are closed in a washing chamber and undergo predetermined automated washing and rinsing steps, the remaining stations need considerable manual interventions and attention from the operators, in particular for loading, for positioning the containers in the filling station and for re-closing with the lids the containers which have been washed and filled.

These manual operations entail an increase in the overall times of the whole process of washing and filling the containers, as well as the need to employ different operators for the same machine, with a consequent increase in management costs.

Furthermore, the manual intervention may not always be precise and repeatable and may entail the risk of accidents for the operators.

It is also known to dispose and group together a plurality of containers in suitable washing baskets, so as to hold the containers in a desired disposition during all the operating steps of the machine.

It is also known to provide that the baskets define a plurality of containing cells for the containers, conformed to prevent the accidental exit of the containers from the basket, so as to be able to provide the upending of the basket inside the washing chamber, for example to facilitate dripping after the washing and rinsing step.

One of the manual operations which most entails an increase in the times and management costs of known machines is the step where the baskets are positioned upstream of the filling station in order to predispose the containers in the suitable filling position.

Indeed, the baskets exit from the washing station upended by 180° with respect to the initial loading position, that is, with the containers having the relative apertures facing downward. Said upending is due to the need to allow and facilitate the dripping of the washing and rinsing liquids, also from inside the containers.

For this reason, the operator in charge of positioning the baskets upstream of the filling station must, of necessity, rotate each basket by 180°, so as to bring the containers with their aperture facing upward and to facilitate the filling thereof due to gravity.

Said upending must be carried out with precision, because the containers must be in positions corresponding to the relative filling nozzles of the filling station, so as to guarantee a correct and complete filling thereof.

Furthermore, between the washing station and the filling station continuity is provided between the belts which transfer the baskets through the different operating stations, because different operating speeds are provided between the different stations. This operative embodiment can also entail a difficult and imprecise positioning of the upended basket immediately upstream of the filling station.

A system for manipulating bottles to be washed and filled is disclosed by the document FR-A-1039114.

One purpose of the present invention is to produce a machine, and perfect a method, which allows to remove the lids or capsules, if they are provided, to wash, fill and possibly to re-close the containers in a simple, economic and efficient way, in a substantially automated manner and reducing to a minimum the manual interventions of the operators.

Another purpose of the present invention is to perfect a device which allows to optimize the positioning steps of the containers downstream of the washing station and upstream of the filling station, guaranteeing an accurate and correct positioning of the containers on each occasion.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

According to one feature of the present invention, a machine for treating containers of liquids, for example feeding bottles contained in an orderly way in baskets, comprises in succession at least a loading station, and a washing station, in which the containers are subjected at least to washing.

In particular, the containers to be subjected to treatment are loaded into the loading station, and all disposed according to a pre-determined first orientation.

In the washing station, the containers are disposed in a second orientation able to facilitate the fall, due to gravity, of the dirt and/or the washing liquid in the containers.

Moreover, the containers are transported at exit from the washing station by means of first movement means, and are then transported toward further operating stations by second movement means.

According to a characteristic feature of the present invention, downstream of the washing station and outside it, the machine comprises a manipulator device, which comprises gripping means conformed so as to both pick up the containers from the first movement means and also to automatically rotate the containers exiting from the washing station, so as to reposition the containers according to the determinate first orientation in coordination with possible subsequent operations or treatments, to be carried out, and also to position the rotated containers on the second movement means, so as to send them to possible subsequent processes or treatments.

The present invention allows to wash and fill the containers in a simple, economic and efficient way, in a substantially automated manner and reducing to a minimum the manual interventions of the operators.

In the case where the containers are loaded closed by suitable lids, relative de-lidding and re-closing stations are associated with the loading station and the washing station. Advantageously the passage of the containers between the first orientation and the second orientation occurs by means of upending means provided in the de-lidding station.

In particular, thanks to the automatic rotation of the containers exiting the washing station by means of the manipulator device, the present invention allows to optimize the steps of positioning the containers downstream of the washing station and upstream of the filling station, guaranteeing the precision and correctness of the positioning of the containers in a repeatable manner.

Another feature of the present invention concerns a manipulator device, in which the gripping means comprise at least a pair of gripping pincers to grip the containers. The pincers are made of the rotatable type so as to determine the automatic rotation of the containers.

The manipulator device according to the invention determines a first approach and positioning/gripping movement of the gripping pincers with respect to the containers, a second movement of automatic rotation of the containers and a third movement of forward translation of the rotated containers, of the first movement means toward the second movement means.

The manipulator device according to the invention comprises a support plate mounted sliding to promote the first movement of approach and positioning/gripping of the gripping pincers, a slider mounted sliding along a plate attached transversely to the support plate, to promote the third movement of forward translation, and an attachment flange constrained rotatably to the slider, to allow the second movement of rotation.

Another feature of the present invention concerns a method for treating containers of liquids comprising at least:

a first loading step of the containers to be subjected to treatment, closed by a relative lid and all disposed according to a determinate first orientation;

a second step in which the containers are subjected to at least washing and are disposed in the second orientation;

a parallel first movement step in which the containers are moved at exit from the washing station by first movement means; and a second movement step in which the containers are moved by second movement means toward possible further operating stations.

According to one feature of the present invention, the method comprises, subsequent to the second step, a third step in which, by means of a manipulator device provided with gripping means, it is provided to both pick up the containers from the first movement means, and to automatically rotate the containers exiting from the washing station in order to dispose the containers again in the first orientation in coordination with possible subsequent operations, or treatments to be carried out, and also to position the containers on the second movement means.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF A PREFERENTIAL FORM OF EMBODIMENT

Figure 1:
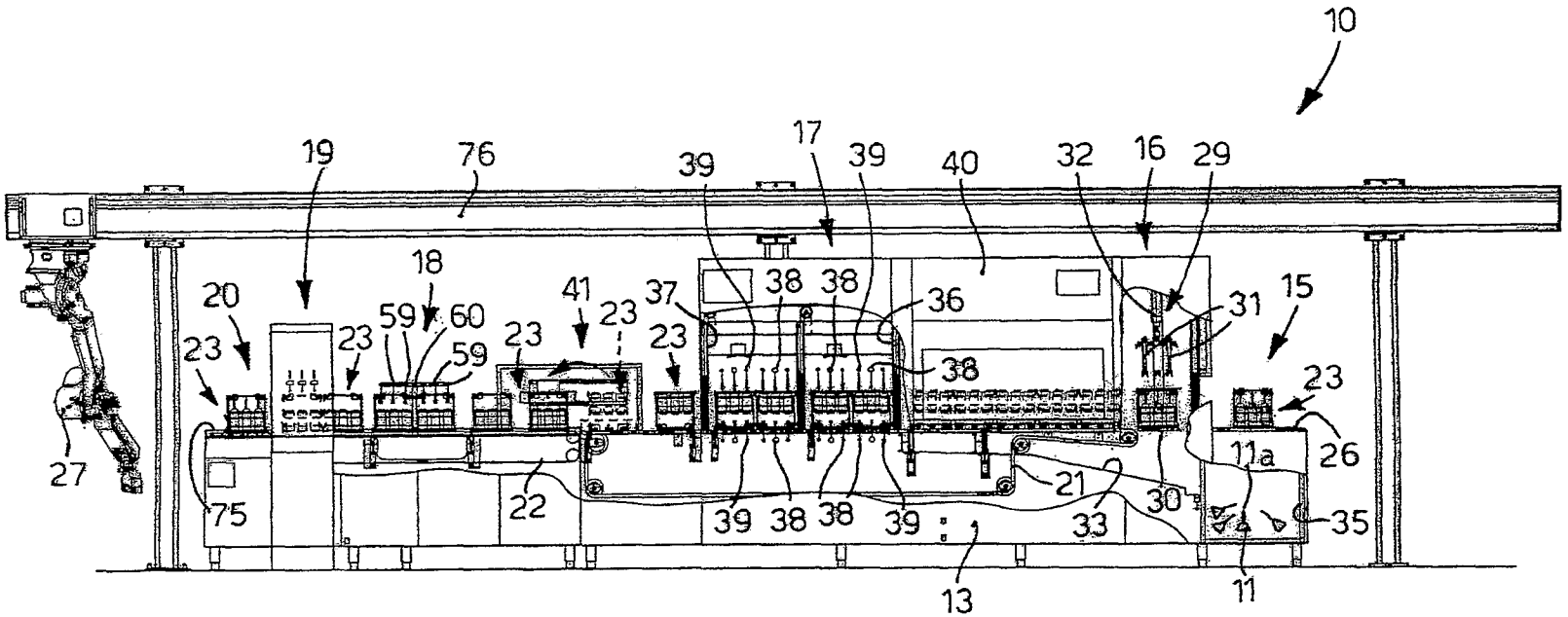
FIG. 1 shows schematically a lateral view of a machine for treating containers of liquids according to the present invention.

With reference to the attached drawings, a machine 10 according to the present invention can be used for the treatment of feeding bottles 12 in order to feed small animals, such as guinea pigs, mice, hamsters and others, used for example in pharmaceutical research laboratories.

The feeding bottles 12 are normally closed at the top by means of relative lids 11, or capsules, made of metal and conformed to define a lip 11*a* from which the animal consumes the liquid contained therein.

In particular the machine 10 according to the present invention allows to de-lid, wash, fill and re-close the feeding bottle 12 in an automated way.

The treatment machine 10 comprises a frame 13, with respect to which a loading station 15, a de-lidding station 16, a washing station 17, a filling station 18, a re-closing station 19 and an unloading station 20 are disposed in sequence.

The movement of the feeding bottles 12 between the aforesaid stations 15, 16, 17, 18, 19 and 20 occurs by means of two conveyor belts, respectively a first 21 and a second 22, disposed one after the other along a determinate direction of feed.

In particular the first belt 21 allows the movement of the feeding bottles 12 between the loading station 15, the de-lidding station 16 up to the exit from the washing station 17, while the second conveyor belt 22 moves the feeding bottles 12 between the filling station 18, the re-closing station 19 and the unloading station 20.

In this case the feeding bottles 12 are disposed inside relative containing baskets 23, which are typically provided with a plurality of cells 25: the cells 25 have a desired ordered disposition, for example in rows or columns. Each cell 25 is conformed to house a relative feeding bottle 12 and hold it in a determinate ordered position with respect to the other feeding bottles 12.

In this case the cells 25 are conformed to allow the positioning of the feeding bottles 12 and to prevent them from accidentally coming out, in particular in an upended condition at 180° of the containing basket 23.

In fact, during the washing of the feeding bottles 12, the containing basket 23 is rotated, as will be explained hereafter in more detail, between two rotated positions one at 180° with respect to the other.

The loading station 15 comprises a loading plane 26 on which the baskets 23 containing the feeding bottles 12, dirty and closed with the lid 11, are disposed.

The progressive positioning of the baskets 23 on the loading plane 26 is carried out in an automated way by means of an anthropomorphic robot 27.

The de-lidding station 16 is downstream of the loading station 15 and comprises a member 29 to extract the lids 11, and an upending device 30 to upend the baskets 23.

In this case, the extractor member 29 comprises a plurality of extraction heads 31 of the pneumatic type and movable vertically by means of a linear actuator 32; the extraction heads 31 cooperate with the lips 11*a* of each lid 11 in order to blow in pressurized air into the feeding bottles 12 and cause the release of the lids 11 from the relative feeding bottles 12. The extraction heads 31 are provided singly or in groups and act automatically on the lips 11*a* of the lids 11 according to the positioning pattern of the feeding bottles in the basket 23.

The upending device 30 rotates the basket 23 through 180° after the release of the lids 11, so that in an upturned condition of the feeding bottles 12, that is, with the relative aperture open toward the bottom, the lids 11 fall due to gravity onto a slide 33 provided on a lower part of the frame 13.

The lids 11 are directed along this slide 33 and collected in relative containing boxes 35, provided, in this case, to limit the bulk, below the loading plane 26.

The upended baskets 23 are progressively moved by the first belt 21 to reach the washing station 17. During this movement, facilitated by the upended position, the residual liquids in the feeding bottles 12 tend to exit due to gravity.

The washing station 17 comprises a first chamber 36 and a second chamber 37, in this case separated from each other.

It is not excluded that according to some variants, the first chamber 36 and the second chamber 37 can be integrated into one single chamber, just as more than two washing chambers can be provided.

Both inside the first chamber 36 and inside the second chamber 37 a plurality of first nozzles 38 and second nozzles 39 are disposed, on the opposite side with respect to the first belt 21.

In this case the first nozzles 38 are able to deliver a washing liquid toward the feeding bottles 12, while the second nozzles 39 are able to deliver a rinsing liquid toward the feeding bottles 12.

In a solution in which in each chamber 36 and 37 both types of nozzles 38 and 39 are provided, the feeding bottles 12 contained in each basket 23 substantially are subjected to two repeated cycles of washing and rinsing.

In an alternative solution in which only first nozzles 38 are provided in the first chamber 36 and only second nozzles 39 are provided in the second chamber 37, the feeding bottles 12 contained in each basket 23 are subjected to only one washing cycle which has longer and more intense steps.

One, the other or both these operating solutions can be chosen on each occasion depending on the type of washing to be carried out and/or other operating parameters.

According to another variant only one washing chamber for the two steps of washing and rinsing can be provided; the basket 23 containing the feeding bottles 12 enters into said single washing chamber.

According to a variant the baskets 23 go into the two chambers 36 and 37, or into the single chamber, one at a time or in pairs or more, so as to reduce the step time.

According to another variant, the baskets 23 stay inside the chambers 36 or 37, or in the single chamber, for the time needed for the treatment, or for the treatments provided, providing a step-wise movement of the first belt 21.

According to a further variant, the first belt 21 moves the baskets 23 inside the chambers 36 or 37 continuously or without stopping, at a speed coordinated to the process times.

In this case, the de-lidding station 16 and the washing station 17 are included and contained inside a single closed cabin 40, which isolates said stations 16 and 17 from the outside environment in order to prevent the spilling of liquids and contamination of the work environment.

Outside the cabin 40, between the washing station 17 and the filling station 18, substantially in correspondence with the zone in which the first belt 21 and the second belt 22 meet, a manipulator device 41 to manipulate the baskets 23 is provided. The manipulator device 41 is suitable to automatically rotate the baskets 23 exiting from the washing station 17 by 180°, in order to return the feeding bottles 12 contained therein with their relative apertures open toward the top.

Figure 2:
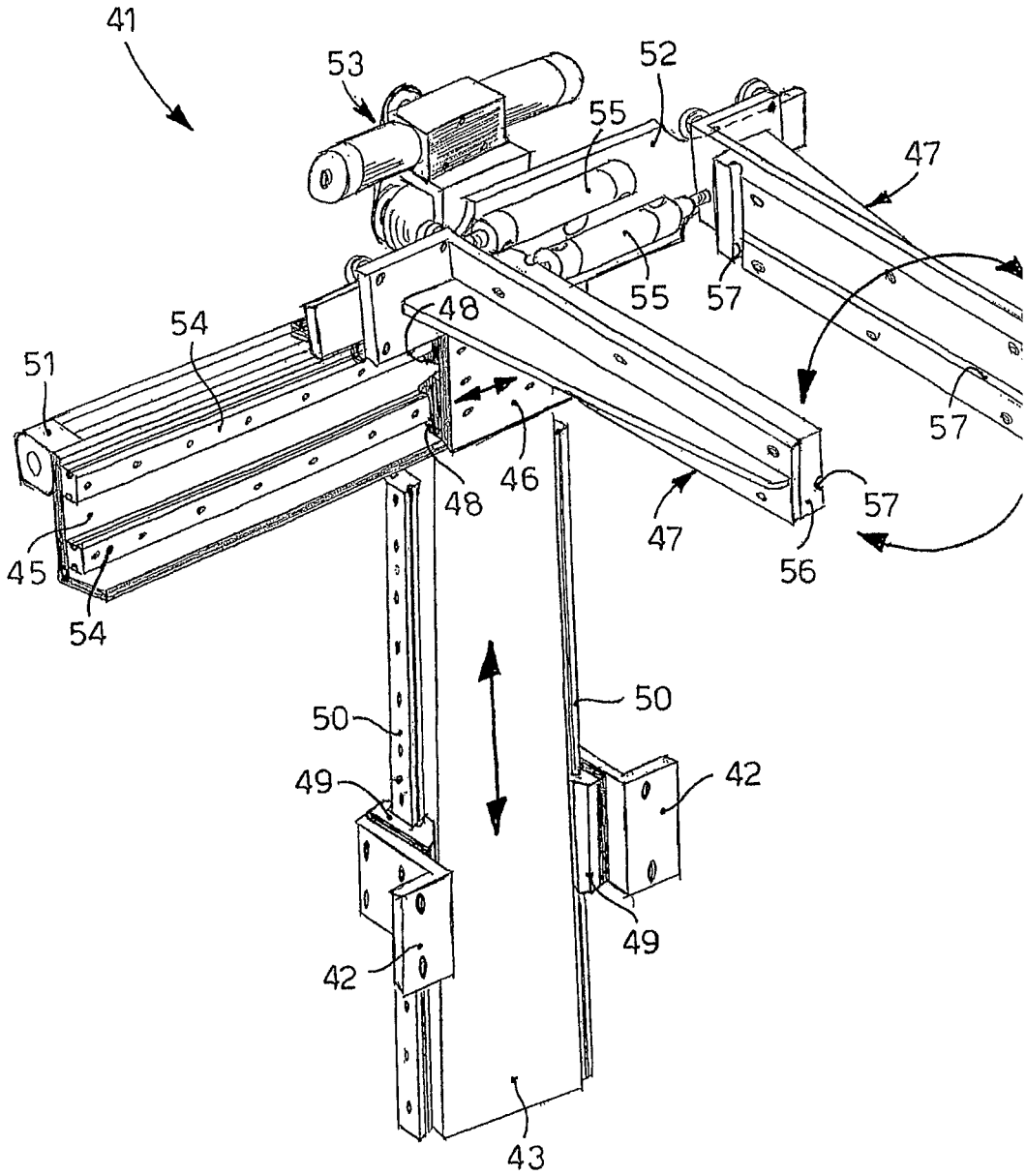
FIG. 2 shows a three-dimensional view of an enlarged detail of the machine in FIG. 1, in an inactive condition.
Figure 3:
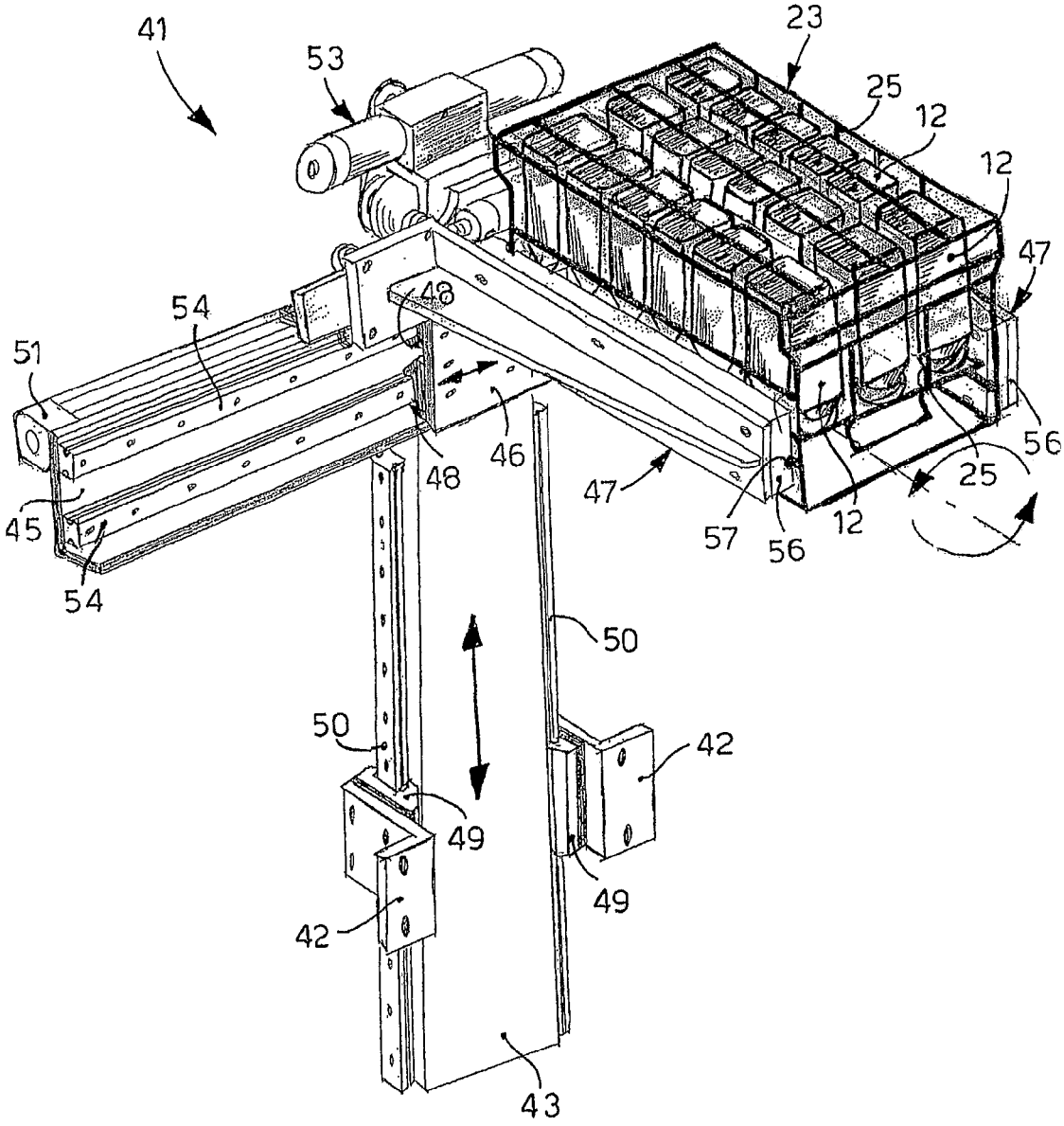
FIG. 3 shows a three-dimensional view of the detail in FIG. 2, in a possible operating condition.

With particular reference to FIGS. 2 and 3, the manipulator device 41 is mounted movable and sideways on the frame 13, by means of two relative brackets 42.

The manipulator device 41 comprises a support plate 43 with a substantially vertical extension, a transverse plate 45 attached substantially perpendicular to the support plate 43, a slider 46 mounted sliding longitudinally on the transverse plate 45 and a pair of gripping pincers 47 mounted rotatable on the slider 46.

The support plate 43 is mounted sliding in a substantially vertical direction on the brackets 42. The sliding assembly of the support plate 43 is typically achieved by means of blocks 49 and linear guides 50, while the movement is selectively actuated by a relative drive member, of the substantially known type and not shown here. For example the drive member can be a traditional electric motor, brushless or other type, and it cannot be excluded that the movement can be actuated by a mechanical, hydraulic or other actuator.

The transverse plate 45 is attached with a median part at the upper end of the support plate 43, so as to move vertically with the latter. On one side of the transverse plate 45 two linear guides 54 are mounted, and on the other side a linear actuator 51, which is attached at the back to the slider 46 in order to determine the selective movement thereof with respect to the transverse plate 45.

The slider 46 comprises two blocks 48 mounted sliding on the linear guides 54 of the transverse plate 45, so as to provide a guided movement with respect to the latter.

The two gripping pincers 47 are assembled reciprocally movable, in a movement of relative approach and separation, on an attachment flange 52, in order to grip the basket 23 to be upended. The reciprocal travel between the two gripping pincers 47 is coherent with the sizes of the basket 23 to be handled.

The attachment flange 52 is in turn rotatably constrained to the slider 46, in order to allow the rotating assembly of the gripping pincers 47 with respect to the transverse plate 45. This rotation is actuated by a drive member 53 mounted to the rear of the attachment flange 52 with respect to the position of the gripping pincers 47.

The reciprocal movement of approach and separation of the gripping pincers 47 is obtained by means of relative actuators 55 attached on the front part of the attachment flange 52.

Moreover, the gripping pincers 47 are disposed parallel to each other, they have a substantially horizontal extension and each of them has an internal wall 56 provided on the surface with relative positioning grooves 57.

The positioning grooves 57 are suitably made and conformed depending on the conformation of the baskets 23, so as to cooperate with the latter in order to guarantee that the baskets 23 are held securely and stably during the operating steps, substantially without any risk of them slipping accidentally.

The manipulator device 41 as described heretofore allows to grip each basket 23 laterally with the gripping pincers 47, to lift it from the first belt 21, by moving the support plate 43, to rotate it by 180°, by rotating the attachment flange 52, to translate it laterally, by moving the slider 46, and to position it on the second belt 22, by means of the vertical movement toward the bottom of the support plate 43.

The upended baskets 23 are positioned by the manipulator device 41 on the second belt 22, which positions them in correspondence with the filling station 18.

The filling station 18 comprises a plurality of filling nozzles 59, which are disposed in suspension above the belt 22 at a height which is higher than that of the baskets 23.

In particular the filling nozzles 59 are assembled on a frame 60, which is also conformed so as to dispose the filling nozzles 59 according to the positioning pattern of the feeding bottles 12 inside the baskets 23.

In this way, each feeding bottle 12 is filled from above substantially without any liquid being wasted and guaranteeing great precision, uniformity and completeness in the filling.

Advantageously the filling nozzles 59 are operatively associated with timer and/or flow control means, of the substantially known type and not shown in the drawings, which allow to carry out a filling of the feeding bottles 12 with a predetermined quantity of filling liquid. This solution allows to completely automate the filling steps, preventing overflowing of the feeding bottles 12.

The filled feeding bottles 12 are brought to the re-closing station 19 which, in an automated manner, repositions the lids 11 on the relative feeding bottles 12 and hermetically attaches them.

Once the steps of closing all the feeding bottles 12 contained in a basket 23 have finished, the second belt 22 transports the basket 23 toward the unloading station 30, positioning it on a relative unloading plane 75.

The baskets 23, thus positioned, are picked up by the anthropomorphic robot 27 and positioned in relative discharge sliders, of a known type and not shown.

The anthropomorphic robot 27 is mounted movable on a track 76 disposed above the operating stations 15, 16, 17, 18, 19 and 20, and extending for the whole length of the frame 13, in order to carry out both the operations of loading the baskets 23 with the feeding bottles 12 to be washed and filled, and also the unloading of the feeding bottles 12 which have been washed and filled.

According to a variant, two anthropomorphic robots 27 are provided, respectively, one for loading the baskets 23 with the feeding bottles 12 to be washed and filled, and one for unloading the baskets 23 with the feeding bottles 12 which have been washed and filled.

It is clear that modifications and/or additions of parts or steps may be made to the treatment machine 10, to the method and to the manipulator device 41 as described heretofore, without departing from the field and scope of the present invention.

For example it comes within the scope of the present invention to provide a control and command unit of the programmed and programmable type, which is electronically connected to each of the operating stations 15, 16, 17, 18, 19 and 20, and/or to the remaining command members provided, in order to selectively coordinate the different functioning cycles of the machine 10, actuating a sequence which is substantially continuous.

It is also clear that, although the present invention has been described with reference to some specific examples, a person of skill in the art shall certainly be able to achieve many other equivalent forms of machine and method for the treatment of containers of liquids, and a manipulator device for said containers, having the characteristics as set forth in the claims and hence all coming within the field of protection defined thereby.

The invention claimed is:

1. A machine suitable for treating containers (12) of liquids disposed according to an order inside relative baskets (23) provided with a plurality of cells (25) having an ordered disposition in rows or columns and conformed to house and hold said containers (12), the machine comprising:

a loading station (15) suitable for loading containers (12) to be treated, all containers (12) being disposed according to a determinate first orientation inside the plurality of cells (25) of said baskets (23);

a washing station (17) suitable for subjecting at least to washing the containers (12) disposed in a second orientation able to promote a fall due to gravity of dirt or washing liquid present in the containers (12);

first movement means (21) able to transport the containers (12) at least from an exit of said washing station (17);

second movement means (22) disposed in succession to the first movement means (21) and able to transport the containers (12) toward operating stations (19); and a manipulator device (41) downstream of the washing station (17) and outside thereof, the manipulator device (41) comprising gripping means having at least a pair of gripping pincers (47) able both to pick up the containers (12) from said first movement means (21) and also to automatically rotate the containers (12) to reposition the containers (12) according to said determinate first orientation in coordination with said operating stations (19), and also to position the containers (12) on said second movement means (22), wherein the manipulator device (41) is able to determine a first approach and positioning/gripping movement of the gripping pincers (47) with respect to the baskets (23), a second movement of automatic rotation of the baskets (23) and a third movement of forward translation of the rotated baskets (23), from the first movement means (21) toward the second movement means (22), wherein said manipulator device (41) comprises a support plate (43) with a substantially vertical extension slidingly mounted to promote the first movement of approach and positioning/gripping of the gripping pincers (47), a slider (46) slidingly mounted along a transverse plate (45) attached above the support plate (43) to promote said third movement of forward translation, and an attachment flange (52) rotatably constrained to the slider (46) to allow said second rotation movement.

2. The machine as in claim 1, wherein the attachment flange (52) of the manipulator device (41) is rotatably constrained to the slider (46) in order to allow a rotating assembly of the gripping pincers (47) with respect to the transverse plate (45), so as to determine an automatic rotation of about 180° of the containers (12).

3. The machine as in claim 2, wherein the gripping pincers (47) comprise positioning portions (57) which are conformed according to a conformation of the baskets (23) to guarantee retention of the baskets (23).

* * * * *